US007524094B2

(12) United States Patent
Fukawa et al.

(10) Patent No.: US 7,524,094 B2
(45) Date of Patent: Apr. 28, 2009

(54) LAMP UNIT FOR A VEHICLE HEADLAMP

(75) Inventors: Kiyotaka Fukawa, Shizuoka (JP); Hiroyuki Ishida, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 319 days.

(21) Appl. No.: 11/518,927

(22) Filed: Sep. 12, 2006

(65) Prior Publication Data

US 2007/0070638 A1 Mar. 29, 2007

(30) Foreign Application Priority Data

Sep. 13, 2005 (JP) ..... P.2005-264881

(51) Int. Cl.
*F21V 7/05* (2006.01)

(52) U.S. Cl. ..... 362/514; 362/507; 362/539; 362/280; 362/301

(58) Field of Classification Search ..... 362/514, 362/507, 512, 513, 539, 280, 299, 301
See application file for complete search history.

(56) References Cited

FOREIGN PATENT DOCUMENTS

EP 1 260 758 A1 11/2002
EP 1 193 440 A1 4/2003
JP 2000-348508 A 12/2000
JP 2003-317513 A 11/2003

OTHER PUBLICATIONS

German Official Action dated Dec. 10, 2008 (6 pages).

*Primary Examiner*—Ismael Negron
(74) *Attorney, Agent, or Firm*—Sughrue Mion, PLLC

(57) ABSTRACT

A lamp unit including mirror member 18 having an upward reflecting surface 18*a*, which reflects part of reflected light from a reflector 16 upward and is disposed between the reflector 16 and a projection lens 12. The mirror member 18 can be moved in the direction of an optical axis Ax and can take a reference position, where the front end edge 18*a*1 of the upward reflecting surface 18*a* is located at the rear focal point F of the projection lens 12, and a front movement position, which is located forward a predetermined distance from the reference position. When the mirror member is moved to the front movement position, part of the reflected light from the reflector 16 passes through a space behind the mirror member 18 so as to be incident on the lower region of the projection lens 12.

7 Claims, 13 Drawing Sheets

LAMP UNIT FOR A VEHICLE HEADLAMP

This application claims foreign priority from Japanese Patent Application No. 2005-264881, filed Sep. 13, 2005, the entire contents of which are hereby incorporated by reference.

BACKGROUND OF THE INVENTION

1. Field of the Invention

The present invention relates to a lamp unit for a vehicle headlamp, and more particularly to a projector type lamp unit in which a light-emitting device, such as a light-emitting diode, is used as a light source.

2. Background Art

Recently, a lamp unit in which a light-emitting device, such as a light-emitting diode used as a light source, has been employed in a vehicle headlamp,.

For example, JP-A-2003-317513 ("JP '513") discloses projector type lamp unit including: a projection lens which is placed on an optical axis extending in a longitudinal direction of a vehicle; a light-emitting device which faces upward and is placed rearward of a rear focal point of the projection lens in proximity to the optical axis; and a reflector which is placed so as to cover the light-emitting device from the upper side, and which reflects light from the light-emitting device forward while shifting the light toward the optical axis.

In the lamp unit disclosed in JP '513, a mirror member having an upward reflecting surface, which extends rearward in parallel with the optical axis from a vicinity of the rear focal point of the projection lens, is disposed between the reflector and the projection lens. Part of reflected light from the reflector is reflected upward by the mirror member, thereby forming a low-beam light distribution pattern in which an upper end portion has a cut-off line as an inverted projection image of a front end edge of the upward reflecting surface.

In contrast, JP-A-2000-348508 ("JP '508") discloses a projector type lamp unit which does not use a light-emitting device as a light source and includes a movable mirror member. The mirror member can be swung downward by a predetermined angle about a swing axis that extends in a rear end portion of the mirror member in the vehicle width direction.

When a projector type lamp unit having a mirror member such as that disclosed in JP '513 is employed, a low-beam light distribution pattern having a clear cut-off line in an upper end portion can be formed while improving the flux utilization rate of light from a light emitting device. However, in order to form a high-beam light distribution pattern, an additional lamp unit is required.

In a configuration where a movable mirror member such as disclosed in JP '508 is employed as the mirror member and the mirror member is swung downward by a predetermined angle, it is possible to form a high-beam light distribution pattern while the illumination range is expanded to the side above the cut-off line of the low-beam light distribution pattern. Therefore, beam switching between a low beam and a high beam is enabled.

However, in the high-beam light distribution pattern formed by the lamp unit disclosed in JP '508, the lower half portion is formed while maintaining the shape and luminous distribution of the low-beam light distribution pattern. Therefore, for a high-beam light distribution pattern, a short-distance range of a road surface in front of a vehicle is excessively illuminated. There arises a problem in that the visibility of the long-distance range of a road surface in front of a vehicle is not ensured.

The invention has been conducted in view of such circumstances.

SUMMARY OF THE INVENTION

One aspect of the invention is a lamp unit for a vehicle headlamp, including: a projection lens which is placed on an optical axis extending in a longitudinal direction of a vehicle; a light-emitting device which faces upward and is placed rearward of a rear focal point of the projection lens and in proximity to the optical axis; a reflector, which is placed to cover the light-emitting device from an upper side reflects light from the light-emitting device forward while shifting the light toward the optical axis, and a mirror member having an upward reflecting surface, which upward reflects part of reflected light from the reflector, disposed between the reflector and the projection lens. The mirror member is a movable mirror member which is movable along the optical axis, and able to take a reference position where a front end edge of the upward reflecting surface of the mirror member is located in a vicinity of the rear focal point, and a front movement position which is located forward a predetermined distance from the reference position. When the mirror member is moved to the front movement position, part of reflected light from the reflector passes through a space behind the mirror member so that the light is incident on a lower region of the projection lens.

In the above, "light-emitting device" in this invention means a light source having a solid state light-emitting device such as a light-emitting chip which emits light in a substantially point-like manner. In this regard, a type of the light-emitting device is not particularly restricted. For example, a light-emitting diode, a laser diode, or the like can be employed. Furthermore, the "light-emitting device" faces upward and is in proximity to the optical axis. However, it is not necessary that the light-emitting device faces only in a vertically upward direction.

In the above, the "mirror member" can take the reference position and the front movement position which is located more forward by the predetermined distance than the reference position. The specific values of the longitudinal length of "mirror member" and "predetermined distance" are not particularly restricted as long as the values are in a range where part of reflected light from the reflector passes through a space in back of the mirror member to be incident on a lower region of the projection lens.

BRIEF DESCRIPTION OF THE DRAWINGS

The advantages, nature, and various additional features of the invention will appear more fully upon consideration of the exemplary embodiment and modifications thereof. The exemplary embodiment and modifications thereof are set forth in the following drawings.

DETAILED DESCRIPTION OF THE EXEMPLARY EMBODIMENT

Although the invention will be described with respect to exemplary embodiment and modification thereof, the following exemplary embodiment and modifications thereof do not limit the invention.

Figure 1:
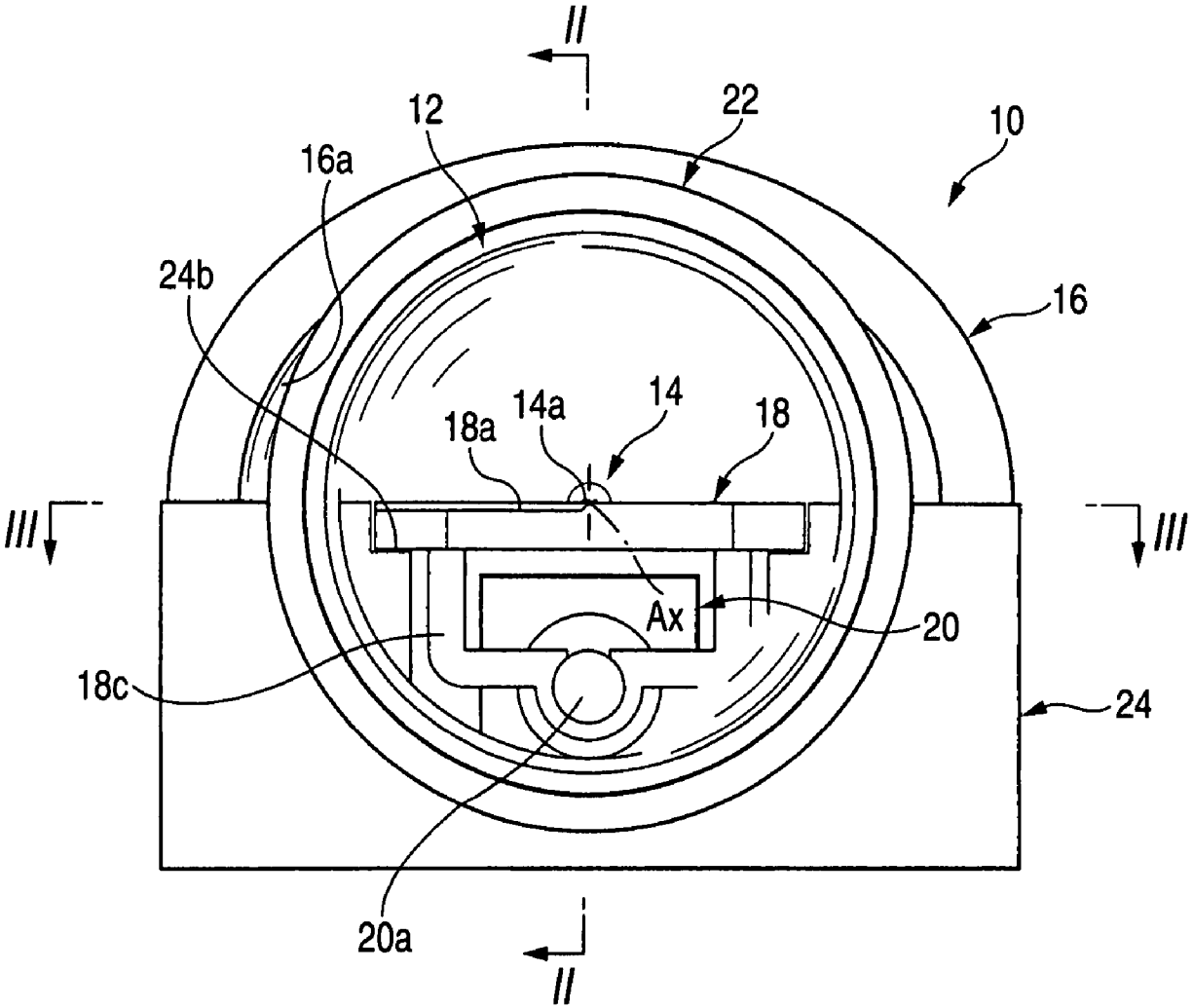
FIG. 1 is a front view showing a lamp unit for a vehicle headlamp of an exemplary embodiment of the invention.
Figure 2:
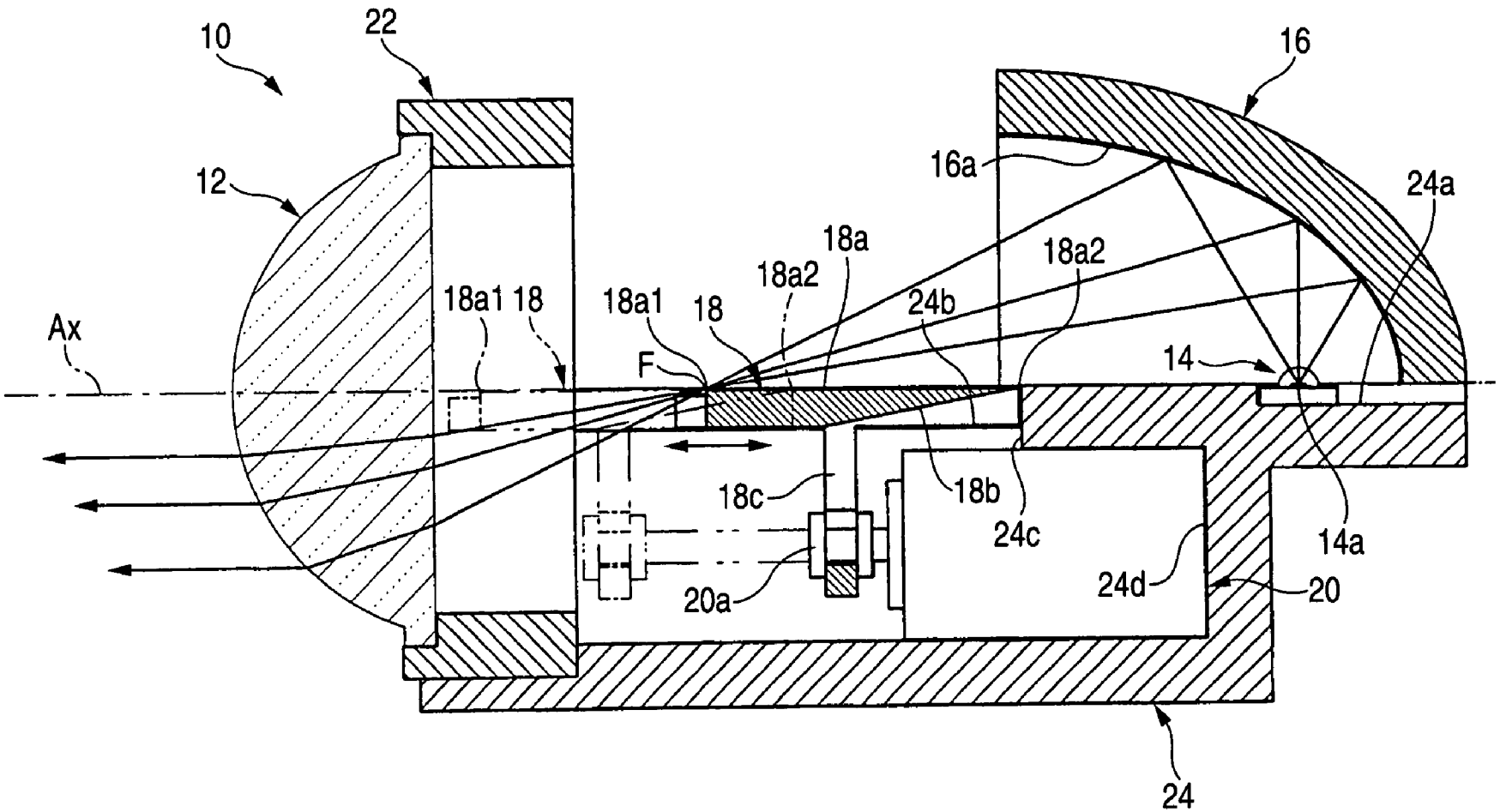
FIG. 2 is a section view taken along line II-II of FIG. 1.
Figure 3:
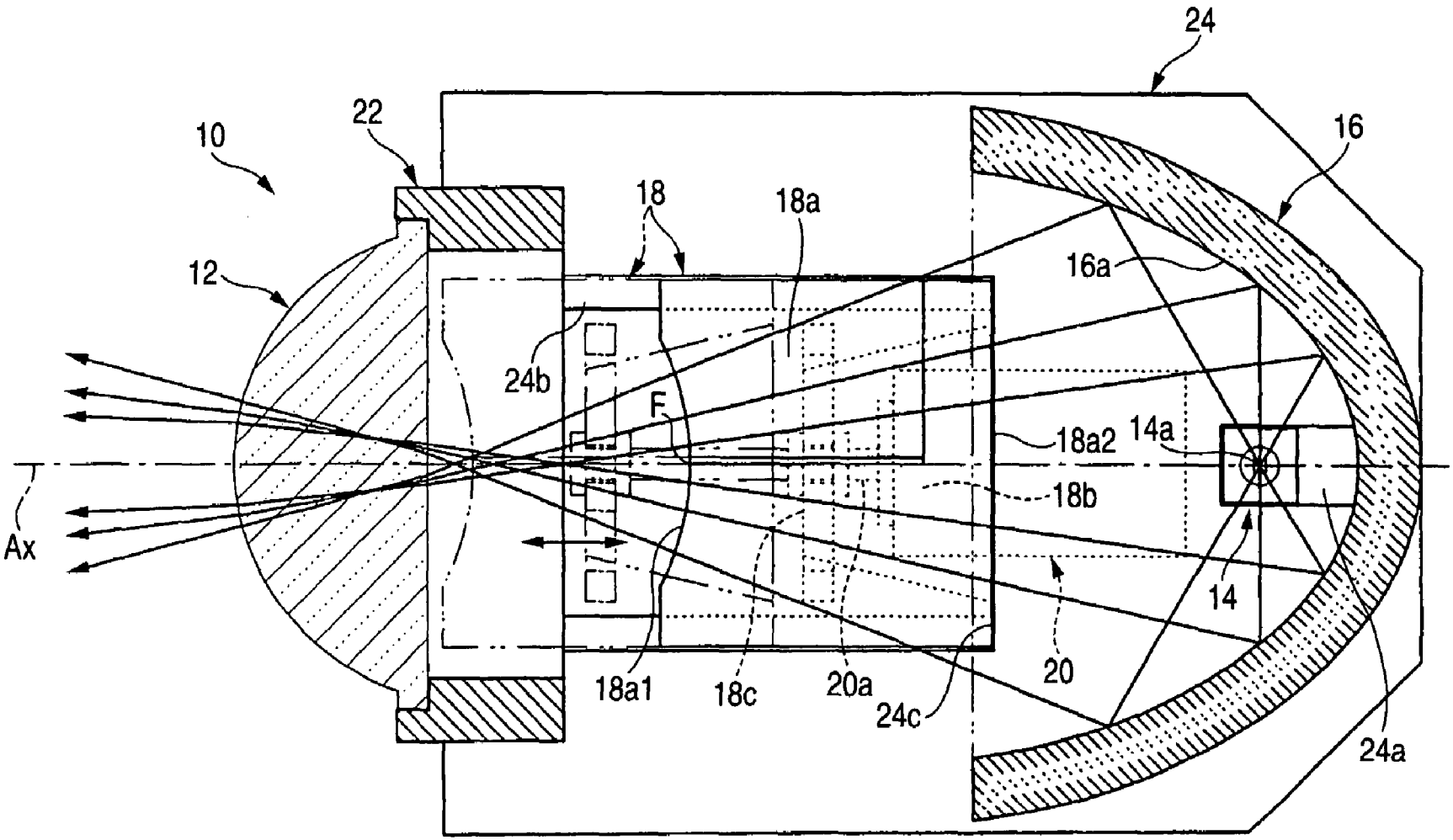
FIG. 3 is a section view taken along line III-III of FIG. 1.

FIG. 1 is a front view showing a lamp unit 10 of the exemplary embodiment of the invention, FIG. 2 is a section view taken along line II-II of FIG. 1, and FIG. 3 is a section view taken along line III-III of FIG. 1.

As shown in the figures, the lamp unit 10 of the exemplary embodiment includes: a projection lens 12 which is placed on an optical axis Ax extending in the longitudinal direction of a vehicle; a light-emitting device 14 which is placed rearward of the rear focal point F of the projection lens 12; a reflector 16 which covers the light-emitting device 14 from an upper side, and which reflects light forward from the light-emitting device 14 while shifting the light toward the optical axis Ax; and a mirror member 18 having an upward reflecting surface 18*a* which extends rearward from the position of the rear focal point F along the optical axis Ax so as to upward reflect part of reflected light from the reflector 16.

The lamp unit 110 is incorporated as a part of a vehicle headlamp and placed in a state where, when incorporated into the vehicle headlamp, the optical axis Ax extends in a downward direction of about 0.5 to 0.6 deg. with respect to the longitudinal direction of a vehicle.

The projection lens 12 is configured as a plano-convex asperical lens in which the front surface is convex and the rear surface is planar. The projection lens 12 projects a light source image formed on the back focal plane (i.e., a focal place including the rear focal point F) as an inverted image onto a virtual vertical screen in front of the lamp unit. The projection lens 12 is secured to an annular lens holder 22 which is fixed in a lower portion to a base member 24.

The light-emitting device 14 is a white light-emitting diode having a light-emitting chip 14*a* that is a 0.3 to 3 mm square. The light-emitting device 14 is positioned and fixed to a light source supporting recess 24*a* formed in the upper face of the base member 24. The light-emitting chip 14*a* is placed on the optical axis Ax and is directed vertically upward.

A reflecting surface 16*a* of the reflector 16 is configured as a generally ellipsoidal curved face which has a major axis coaxial with the optical axis Ax. A luminescence center of the light-emitting device 14 is set as a first focal point of the reflecting face 16*a*. The eccentricity of the reflecting face 16*a* is set so as to gradually increase from a vertical section to a horizontal section. That is, the reflecting surface 16*a* is formed so that, in the vertical section, light from the light-emitting device 14 is converged to the rear focal point F of the projection lens 12, and, in the horizontal section, the converging position is moved considerably forward. The reflector 16 is fixed at a lower end portion of the periphery of the reflecting surface 16*a* to the upper face of the base member 24.

The upward reflecting surface 18*a* of the mirror member 18 is formed by applying a mirror finishing process, due to aluminum deposition or the like, on the upper face of the mirror member 18. In the upward reflecting surface 18*a*, the left region which is situated on the left side of the optical axis Ax (the right side in a front view of the lamp) is configured by a horizontal face including the optical axis Ax, and the right region which is situated on the right side of the optical axis Ax is configured by a horizontal face at a lower level than the left region via a short inclined portion. A rear end portion of the right region is formed so as to be flush with the left region. The front end edge 18*a*1 of the upward reflecting surface 18*a* is formed so as to extend along the back focal plane of the projection lens 12.

The mirror member 18 is configured as a movable mirror member which can be moved in the direction of the optical axis Ax. The mirror member 18 is configured so as to be able to take a reference position (the position indicated by the solid line in FIGS. 2 and 3) where the front end edge 18*a*1 of the upward reflecting surface 18*a* is located at the rear focal point F of the projection lens 12, and a front movement position (the position indicated by the two-dot chain line in FIGS. 2 and 3) which is located forward a predetermined distance from the reference position. In this case, when the mirror member 18 is moved to the front movement position, the front end edge 18*a*1 of the upward reflecting surface 18*a* is located in the vicinity of the rear side surface of the projection lens 12. The movement of the mirror member 18 is realized by driving a solenoid 20 (this will be described later).

Figure 4:
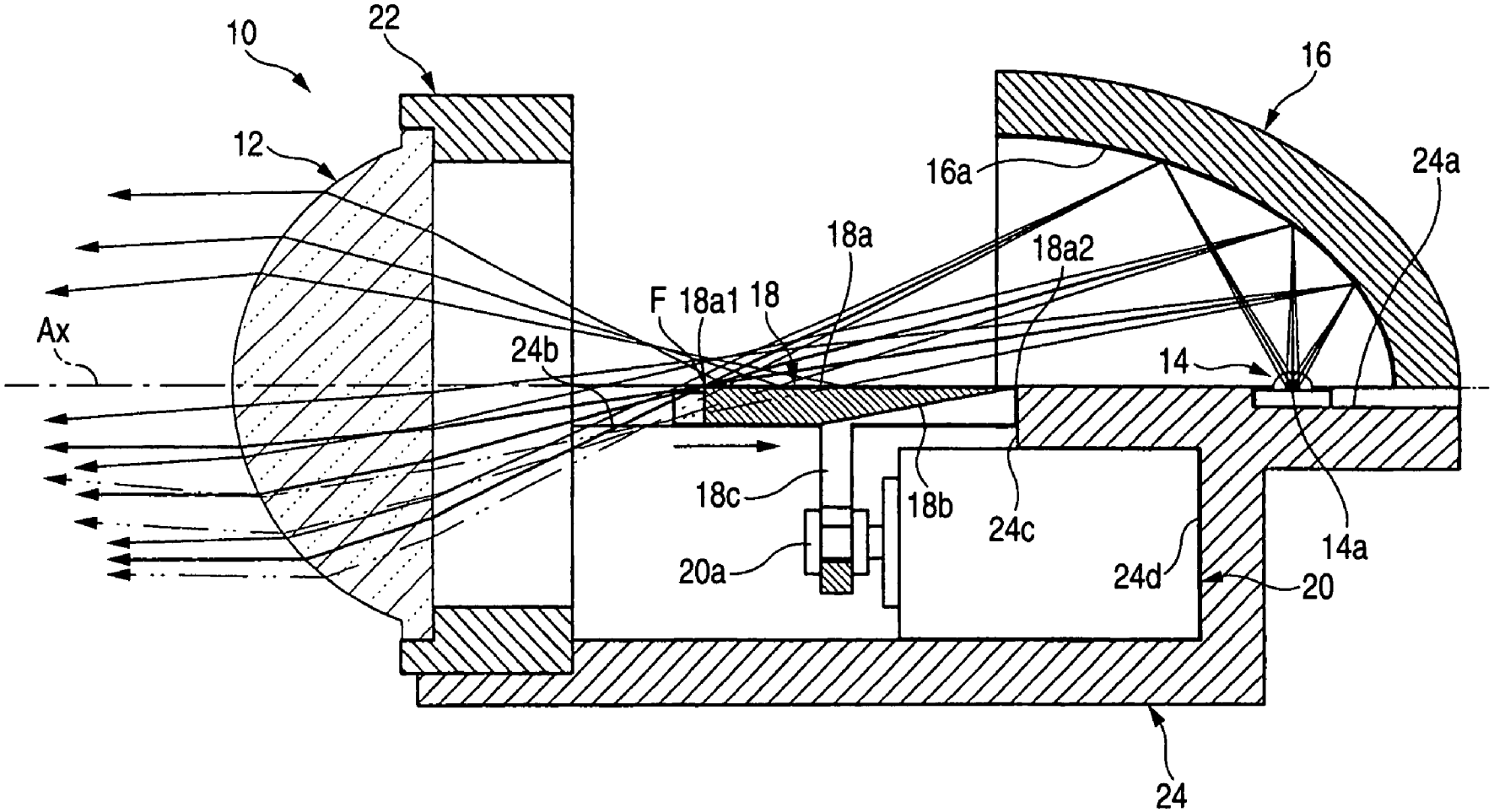
FIG. 4 is a view similar to FIG. 2 showing in detail an optical path when a mirror member of the lamp unit is at a reference position.
Figure 5:
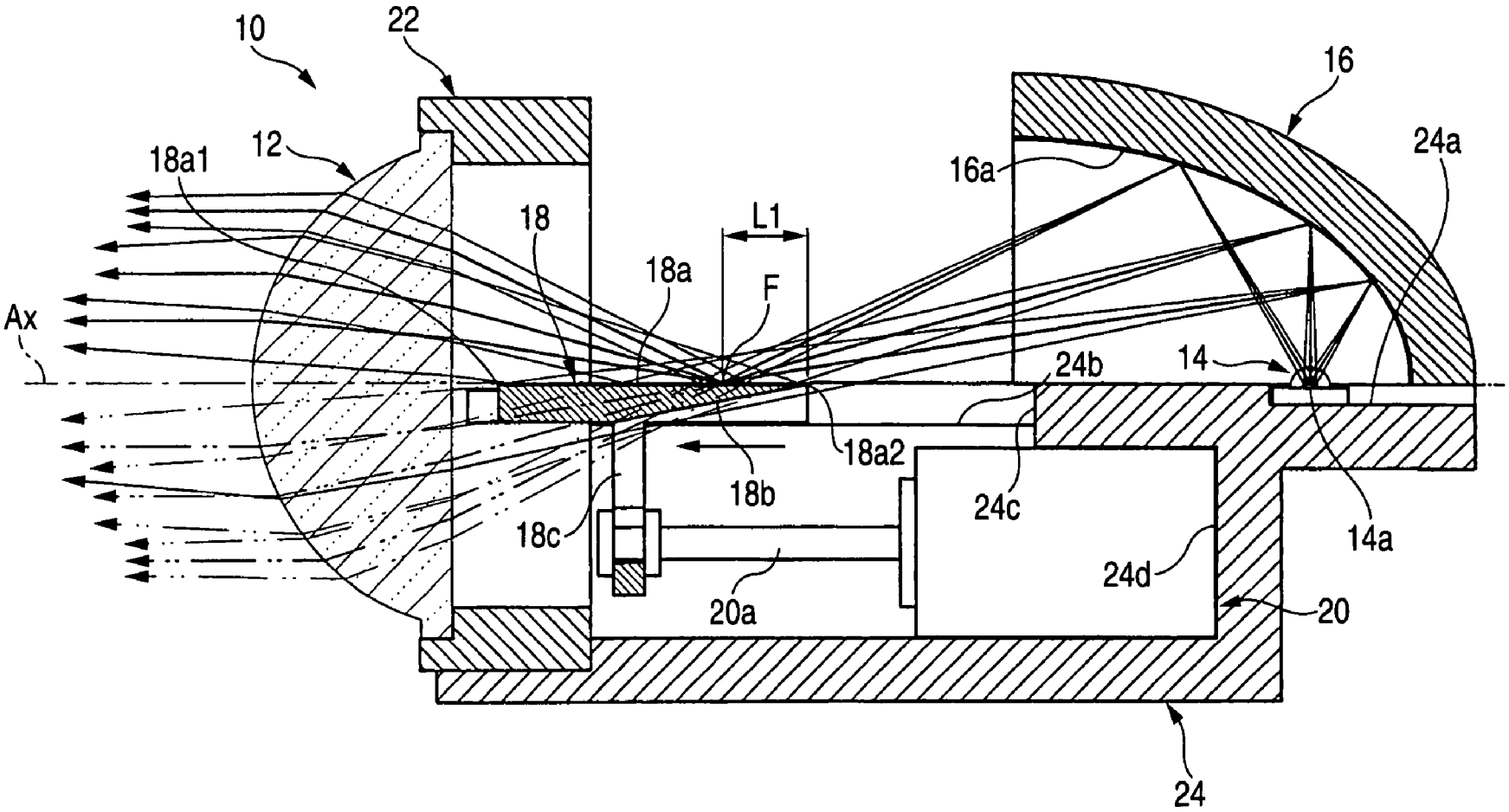
FIG. 5 is a view similar to FIG. 2 showing in detail an optical path when the mirror member is at a front movement position.

FIG. 4 is a view similar to FIG. 2 showing in detail an optical path when the mirror member 18 is at the reference position, and FIG. 5 is a view similar to FIG. 2 showing in detail an optical path when the mirror member 18 is at the front movement position.

As shown in FIG. 4, when the mirror member 18 is at the reference position, the upward reflecting surface 18*a* reflects part of reflected light, which is directed from the reflecting surface 16*a* of the reflector 16 toward the projection lens 12, upward so that the light enters the projection lens 12 and is emitted as downward light from the projection lens 12.

In contrast, as shown in FIG. 5, when the mirror member 18 is moved to the front movement position, most of light, which is reflected by the reflector 16 when the mirror member 18 is at the reference position passes through a space in front of the mirror member 18 so as to be incident directly on a lower region of the projection lens 12, is upward reflected by the upward reflecting surface 18*a* of the mirror member 18 so as to be incident on an upper region of the projection lens 12. At this time, part of the reflected light from the reflector 16 is caused to pass through a space in back of the mirror member 18 so as to be incident directly on the lower region of the projection lens 12.

In order to realize this, the longitudinal length of the mirror member 18 is set so that, when the mirror member is moved to the front movement position, the rear end edge 18*a*2 of the upward reflecting surface 18*a* is located rearward a predetermined distance L1 from the rear focal point F of the projection lens 12. The rear end edge 18*a*2 of the mirror member 18 is formed so as to extend linearly in a direction perpendicular to the optical axis Ax.

The mirror member 18 has a substantially wedge-like vertical section shape in which the thickness is gradually reduced as the substantially wedge-like shape advances from the front end edge of the mirror member 18 toward the rear end edge. Namely, in the mirror member 18, substantially a rear half portion of the lower face is configured by an inclined face 18*b* which linearly extends in an obliquely upward direction. According to the configuration, when the mirror member 18 is moved to the front movement position, it is possible to prevent or suppress the reflected light from the reflector 16 from being blocked by the mirror member 18 itself. However, the inclined face 18*b* is not formed in right and left side portions of the mirror member 18.

In the mirror member 18, a stay 18*c* which extends downward from the lower face is formed. The stay 18*c* is formed into a generally U-like shape in front view, and engaged in a middle portion of the lower end with a plunger 20*a* of the solenoid 20, which will be described later.

In the base member 24, a solenoid attaching portion 24*d* is formed in a portion below the optical axis Ax. The solenoid 20 is attached to the solenoid attaching portion 24*d* so that the plunger 20*a* is protruded forward. The solenoid 20 is engaged in a tip end portion of the plunger 20*a* with the stay 18*c* of the mirror member 18.

The solenoid 20 is driven by operating a beam changeover switch, which is not shown. Namely, when the beam changeover switch is switched to the low-beam position, the plunger 20*a* of the solenoid 20 is retracted to the position shown in FIG. 4 so that the mirror member 18 is moved to the reference position; and, when the beam changeover switch is switched to the high-beam position, the plunger 20*a* is advanced to the position shown in FIG. 5 so that the mirror member 18 is moved to the front movement position.

A pair of mirror member supporting portions 24*b* which support the right and left side portions of the mirror member 18 are formed on the base member 24. The mirror member 18 can linearly reciprocate in the longitudinal direction using the pair of mirror member supporting portions 24*b* as guides. When the mirror member 18 is moved to the reference position, a stopper end face 24*c* formed on the base member 24 butts against rear end faces of the right and left side portions of the mirror member 18 in order to position the mirror member 18 to the reference position.

Figure 6:
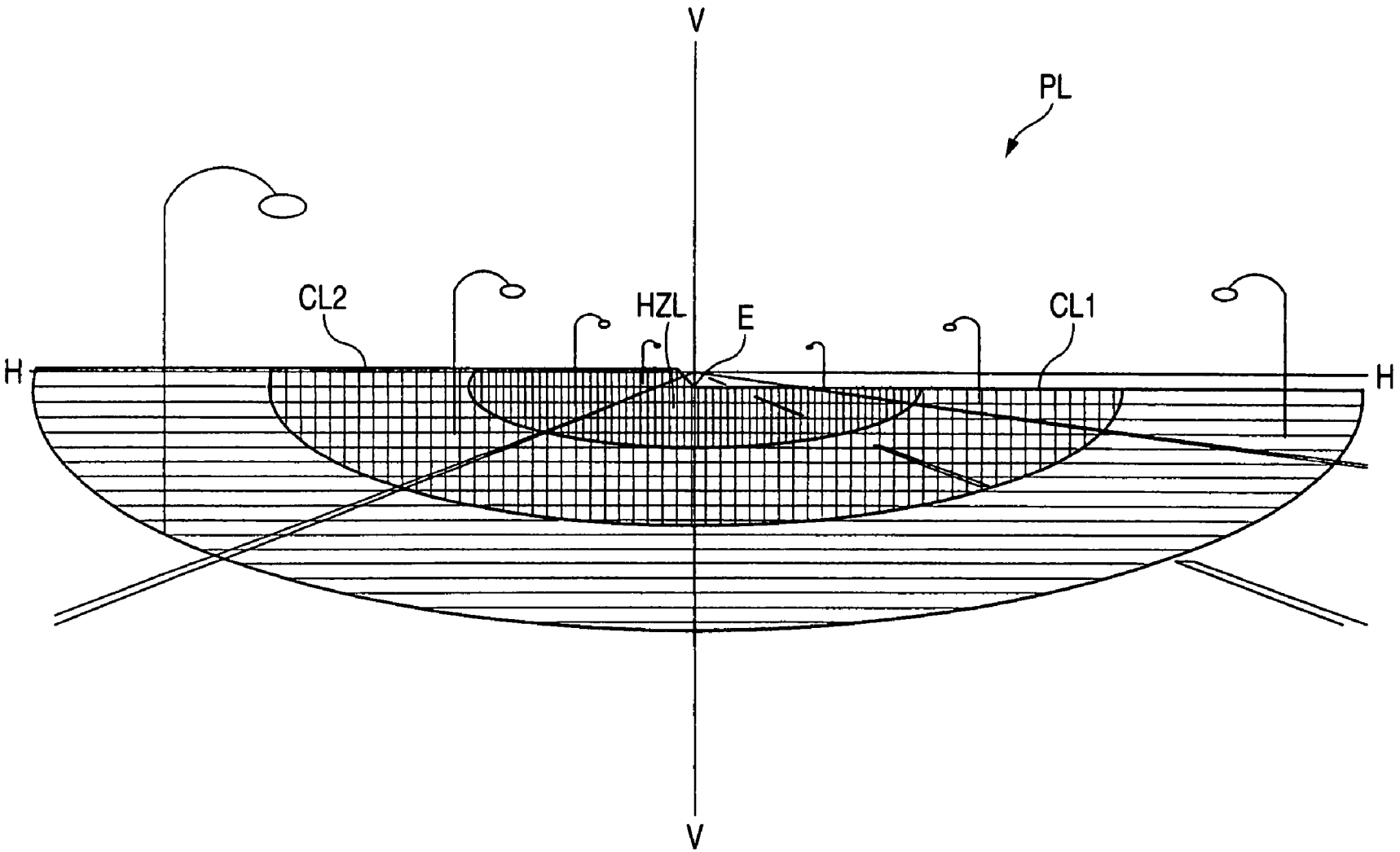
FIG. 6 is a view showing in a transparent manner a low-beam light distribution pattern which is formed on a virtual vertical screen placed at a position 25 m forward from a vehicle by light emitted forward from the lamp unit.
Figure 7:
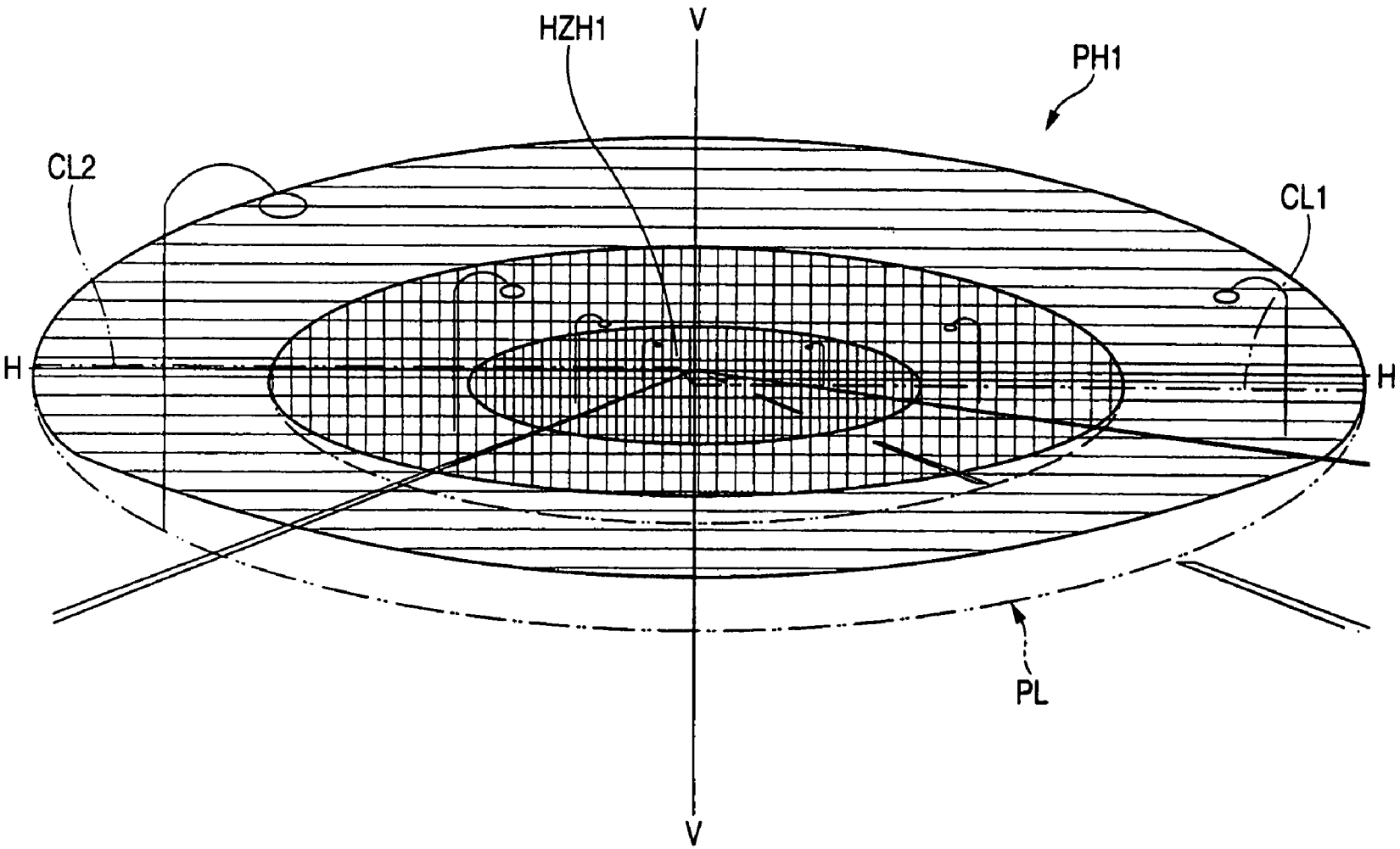
FIG. 7 is a view showing in a transparent manner a high-beam light distribution pattern which is formed on the virtual vertical screen by light emitted forward from the lamp unit.

FIGS. 6 and 7 are views showing in a transparent manner a light distribution pattern which is formed on the virtual vertical screen placed at a position 25 m forward from a vehicle by light emitted forward from the lamp unit 10 of the exemplary embodiment. FIG. 6 shows a low-beam light distribution pattern PL, and FIG. 7 shows a high-beam light distribution pattern PH1.

The low-beam light distribution pattern PL shown in FIG. 6 is a light distribution pattern which is formed when the mirror member 18 is at the reference position.

The low-beam light distribution pattern PL is a low-beam light distribution pattern for left light distribution, and has right and left stepped cut-off lines CL1, CL2 in the upper end edge. The cut-off lines CL1, CL2 horizontally extend in a stepped manner on both sides of line V-V which vertically passes through H-V, that is, the vanishing point in the front direction of the lamp. The opposite-lane portion which is on the right side of the line V-V is formed as the lower cut-off line CL1, and the own-lane portion which is on the left side of the line V-V is formed as the upper cut-off line CL2 which is stepped up from the lower cut-off line CL1 via an inclined portion.

The low-beam light distribution pattern PL is formed in the following manner. An image of the light-emitting device 14 is formed on the back focal plane of the projection lens 12 by light which is emitted from the light-emitting device 14 and reflected by the reflector 16. The image is projected by the projection lens 12 as an inverted projection image onto the virtual vertical screen. The cut-off lines CL1, CL2 are formed as an inverted projection image of the front end edge 18*a*1 of the upward reflecting surface 18*a* of the mirror member 18.

In the low-beam light distribution pattern PL, an elbow point E which is an intersection of the lower cut-off line CL1 and the line V-V is situated below H-V by about 0.5 to 0.6 deg. This is cased by the extension in which the optical axis Ax extends in a downward direction of about 0.5 to 0.6 deg. with respect to the longitudinal direction of a vehicle. In the low-beam light distribution pattern PL, a hot zone HZL1, which is a high brightness area, is formed so as to surround the elbow point E.

The high-beam light distribution pattern PH1 shown in FIG. 7 is a light distribution pattern which is formed when the mirror member 18 is moved to the front movement position.

The high-beam light distribution pattern PH1 is formed as a horizontally extending light distribution pattern which extends vertically and horizontally while centered at the elbow point E. A hot zone HZH of the pattern has a generally ellipsoidal shape which horizontally extends while centered at H-V.

In the high-beam light distribution pattern PH1, the upper half portion has a shape which is obtained by expanding the low-beam light distribution pattern PL to a position that is substantially vertically symmetric about the lower cut-off line CL1, and the lower half portion has a shape in which the low-beam light distribution pattern PL is slightly flattened toward the lower cut-off line CL1. Therefore, illumination on a short-distance range of a road surface in front of a vehicle is suppressed, and the visibility of the long-distance range of the road surface in front of the vehicle is enhanced.

The upper half portion of the high-beam light distribution pattern PH1 has a shape which is obtained by expanding the low-beam light distribution pattern PL to a position that is substantially vertically symmetric about the lower cut-off line CL1 for the following reason. When the mirror member 18 is moved to the front movement position, most of the light, which is reflected by the reflector 16, and which, when the mirror member 18 is at the reference position, passes through a space in front of the mirror member to be incident directly on a lower region of the projection lens 12, is reflected upward by the upward reflecting surface 18*a* of the mirror member 18 so as to be incident on the projection lens 12.

Furthermore, the lower half portion of the high-beam light distribution pattern PH1 has a shape in which the low-beam light distribution pattern PL is slightly flattened toward the lower cut-off line CL1 for the following reason. When the mirror member 18 is moved to the front movement position, part of light, which is reflected by the reflector 16, and which, when the mirror member 18 is at the reference position, is upward reflected by the upward reflecting surface 18*a* to be incident on the projection lens 12, passes through a space in back of the mirror member 18 so as to be incident directly on a lower region of the projection lens 12.

As described above in detail, the lamp unit 10 of the embodiment includes: the projection lens 12 which is placed on the optical axis Ax extending in the longitudinal direction of a vehicle; the light-emitting device 14 which faces upward and is placed rearward of the rear focal point F of the projection lens 12 and in proximity to the optical axis Ax; and the reflector 16 which covers the light-emitting device 14 from the upper side, and which reflects light forward from the light-emitting device 14 while shifting the light toward the optical axis Ax. The mirror member 18 having the upward reflecting surface 18*a* which reflects part of reflected light upward from the reflector 16 is disposed between the reflector 16 and the projection lens 12. The mirror member 18 is configured as a movable mirror member which can be moved in the direction of the optical axis Ax. The mirror member 18 is configured so as to be able to take the reference position where the front end edge 18*a*1 of the upward reflecting surface 18*a* is located in the vicinity of the rear focal point F of the projection lens 12, and the front movement position which is located forward a predetermined distance from the reference position. When the mirror member 18 is moved to the front movement position, part of the reflected light from the reflector 16 passes through a space in back of the mirror member 18 so as to be incident on the lower region of the projection lens 12. Therefore, it is possible to attain the following functions and effects.

Namely, when the mirror member 18 is at the reference position, part of the reflected light from the reflector 16 is reflected upward by the mirror member 18, and the low-beam light distribution pattern PL which in an upper end portion has the cut-off lines CL1, CL2 as an inverted projection image of the front end edge 18*a*1 of the upward reflecting surface 18*a* of the mirror member can be formed. In contrast, when the mirror member 18 is moved to the front movement position, most of the light, which is reflected by the reflector 16, and which, when the mirror member 18 is at the reference position, passes through a space in front of the mirror member 18 to be incident directly on a lower region of the projection lens 12, is reflected upward by the mirror member 18 so as to be incident on the projection lens 12. As a result, it is possible to form the high-beam light distribution pattern PH1 while the illumination range is expanded to the side above the cut-off lines CL1, CL2 of the low-beam light distribution pattern PL. Therefore, beam switching between a low beam and a high beam is enabled.

When the mirror member 18 is moved to the front movement position, part of the reflected light from the reflector 16 passes through a space in back of the mirror member 18 so as to be incident directly on the lower region of the projection lens 12. Therefore, part of light, which, in the low-beam light distribution pattern PL, illuminates a portion below the cut-off lines CL1, CL2, can be diverted so as to provide illumination on the upper side. Consequently, illumination on a short-distance range of a road surface in front of a vehicle is suppressed, and the visibility of the long-distance range of the road surface in front of the vehicle is enhanced. As a result, it is possible to obtain a light distribution pattern which is suitable for the high-beam light distribution pattern PH1.

According to the exemplary embodiment, as described above, when the projector type lamp unit 10 which uses the light-emitting device 14 as a light source is employed as a lamp unit for a vehicle headlamp, the high-beam light distribution pattern PH1 formed by the lamp unit 10 can have an excellent long-distance visibility.

In the exemplary embodiment, moreover, the mirror member 18 has a substantially wedge-like vertical section shape in which the thickness gradually reduces as the substantially wedge-like vertical section advances toward the rear end edge of the mirror member. Therefore, when the mirror member 18 is moved to the front movement position, it is possible to prevent or suppress the reflected light from the reflector 16 from being blocked by the mirror member 18 itself. According to the configuration, the amount of light which passes through a space in back of the mirror member 18 so as to be incident on a lower region of the projection lens 12 can be ensured as much as possible, and the brightness of the high-beam light distribution pattern PH1 can be sufficiently ensured.

Next, modifications of the exemplary embodiment will be described.

First, a first modification of the exemplary embodiment will be described.

Figure 8:
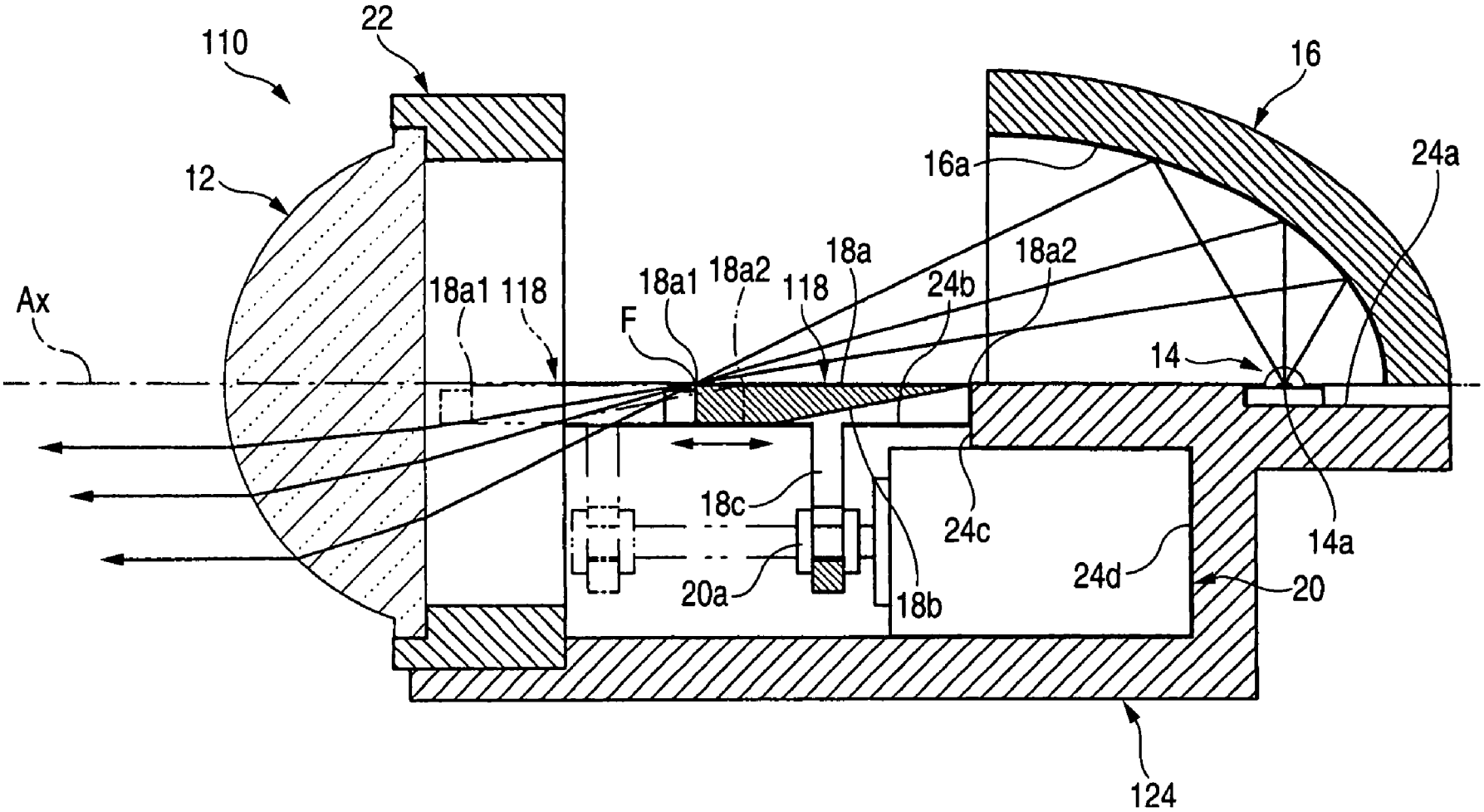
FIG. 8 is a view similar to FIG. 2 showing a lamp unit of a first modification of the exemplary embodiment.
Figure 9:
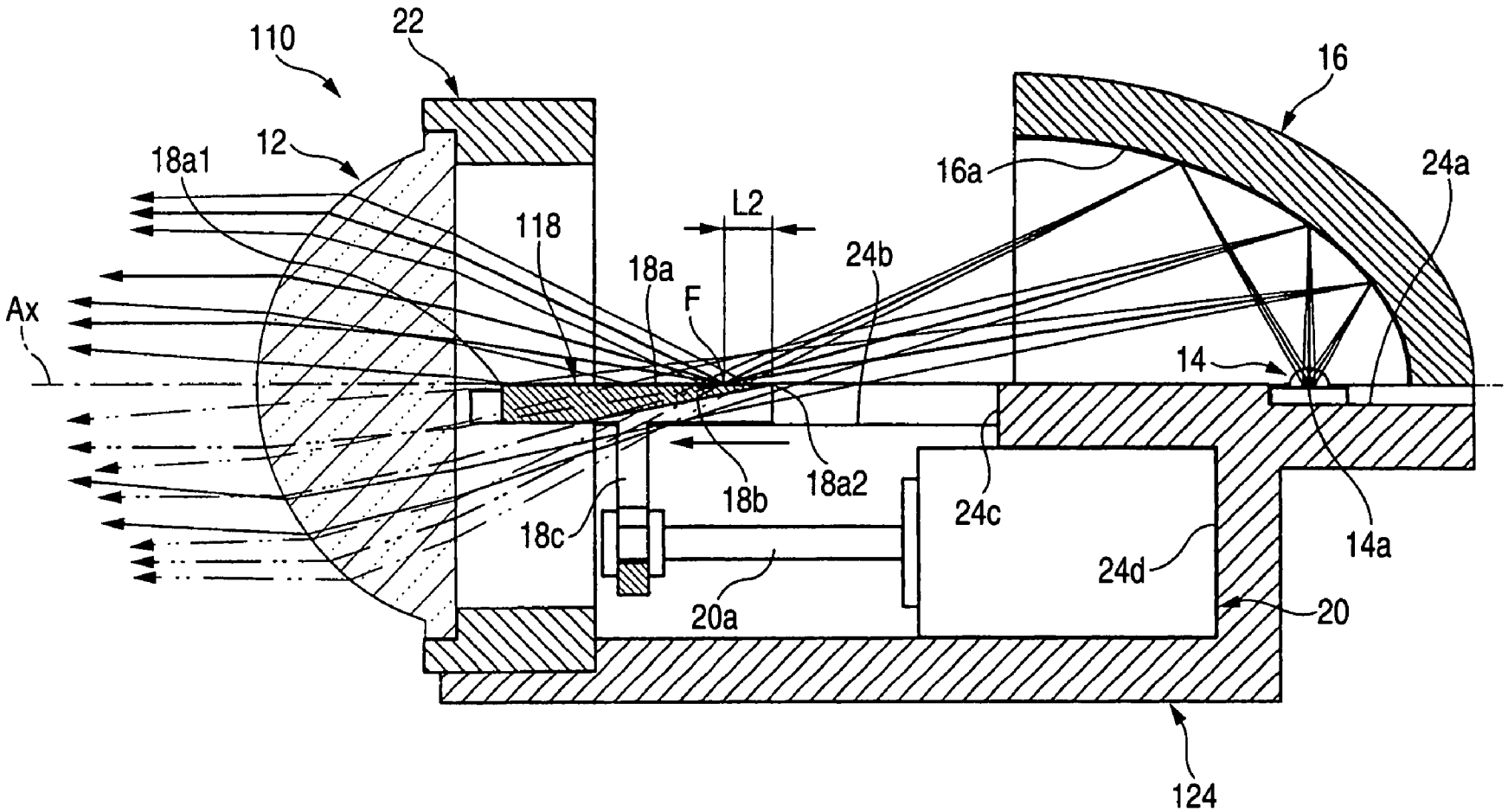
FIG. 9 is a view similar to FIG. 5 showing the lamp unit of the first modification.

FIGS. 8 and 9 are views similar to FIGS. 2 and 5 showing a lamp unit 110 of the modification.

As shown in the figures, in the lamp unit 110, the configuration of a mirror member 118 and a base member 124 is different from that in the exemplary embodiment, but the rest of the configuration is identical with that in the exemplary embodiment.

In the modification, the longitudinal length of the mirror member 118 is set to be slightly shorter than the mirror member 18 in the exemplary embodiment. Specifically, in the mirror member 118 in the modification, the front end edge 18*a*1 of the upward reflecting surface 18*a* is located at the same position as the mirror member 18, but the position of the rear end edge 18*a*2 is located slightly forward of the location of the rear edge 18*a*2 of the mirror member 18 of the exemplary embodiment. According to the configuration, when the mirror member 118 is moved to the front movement position, the rear end edge 18*a*2 of the upward reflecting surface 18*a* is located a predetermined distance L2 (L2<L1) rearward from the rear focal point F of the projection lens 12.

In accordance with the above, in the base member 124 in the modification, the position of the stopper end face 24*c* is set forward a distance corresponding to the length of L1-L2 more than the base member 24 in the exemplary embodiment.

Figure 10:
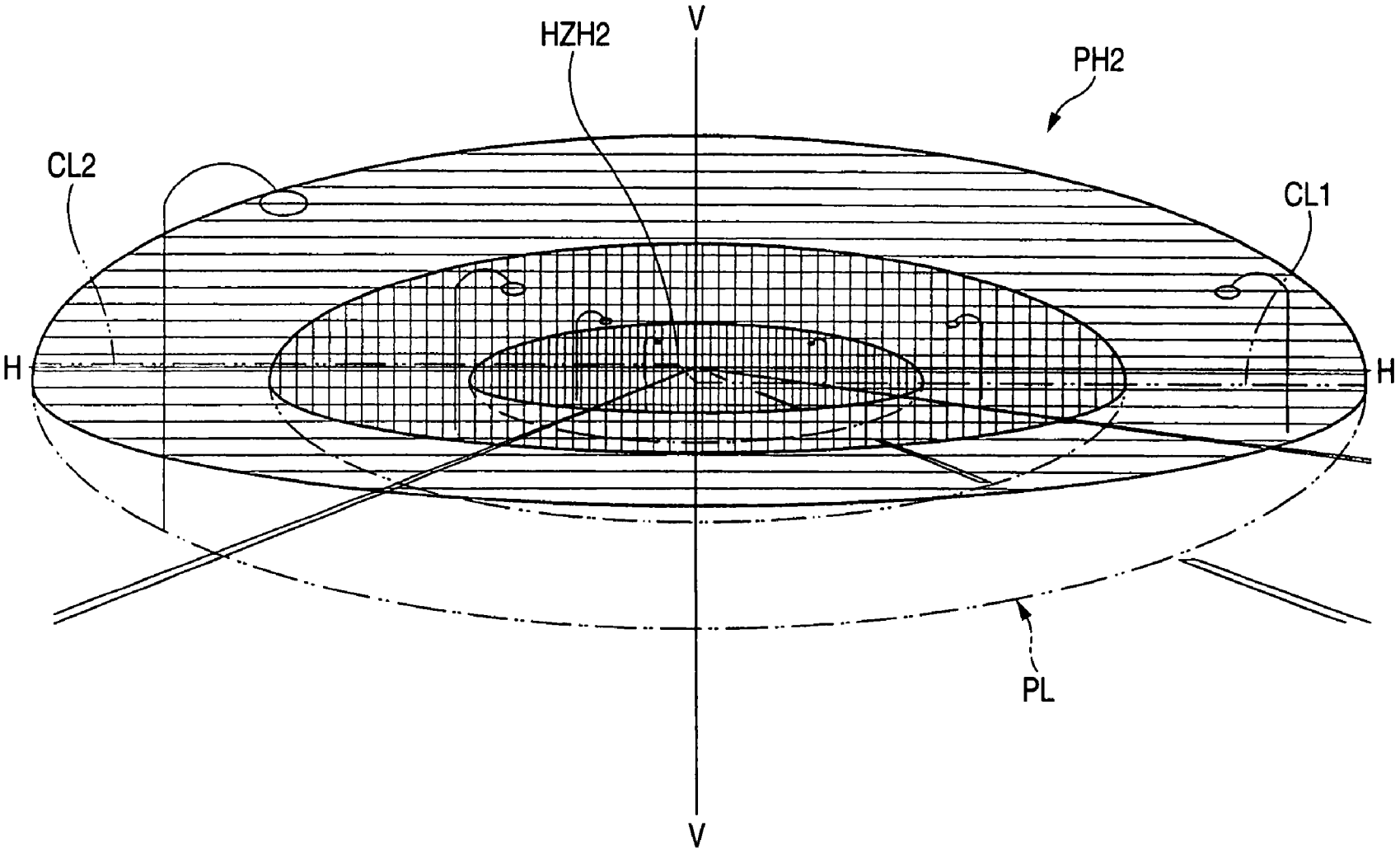
FIG. 10 is a view showing in a transparent manner a high-beam light distribution pattern which is formed on the virtual vertical screen by light forward emitted from the lamp unit of the first modification.

FIG. 10 is a view showing a high-beam light distribution pattern PH2 which is formed on the virtual vertical screen by light that is forward emitted from the lamp unit 110 of the modification.

In the same manner as the high-beam light distribution pattern PH1 in the embodiment, the upper half portion of the high-beam light distribution pattern PH2 has a shape which is obtained by expanding the low-beam light distribution pattern PL to a position that is substantially vertically symmetric about the lower cut-off line CL1, and the lower half portion has a shape in which the low-beam light distribution pattern PL is slightly flattened toward the lower cut-off line CL1. However, the degree of the flattening is larger than that of the high-beam light distribution pattern PH1. A hot zone HZH2 of the high-beam light distribution pattern PH2 is slightly brighter than the hot zone HZH1 of the high-beam light distribution pattern PH1. Consequently, illumination on a short-distance range of a road surface in front of a vehicle is more effectively suppressed, and the long-distance range of the road surface in front of the vehicle is correspondingly more brightly illuminated, whereby the visibility of the long-distance range is further enhanced.

In this case, the flattening degree of the lower half portion of the high-beam light distribution pattern PH2 is larger than that of the high-beam light distribution pattern PH1 for the following reason. When the mirror member 118 is moved to the front movement position, the position of the rear end edge 18*a*2 is located slightly more forward than that of the mirror member 18 in the exemplary embodiment. The amount of light, which is reflected by the reflector 16, and which passes through a space in back of the mirror member 118 so as to be incident directly on a lower region of the projection lens 12, is correspondingly larger than that in the case of the mirror member 18.

Also in the lamp unit 110 of the modification, when the mirror member 118 is at the reference position, the low-beam light distribution pattern PL such as shown in FIG. 6 is formed in the same manner as the exemplary embodiment.

According to the modification, the high-beam light distribution pattern PH2 can have a long-distance visibility which is better than the exemplary embodiment.

Next, a second modification of the exemplary embodiment will be described.

Figure 11:
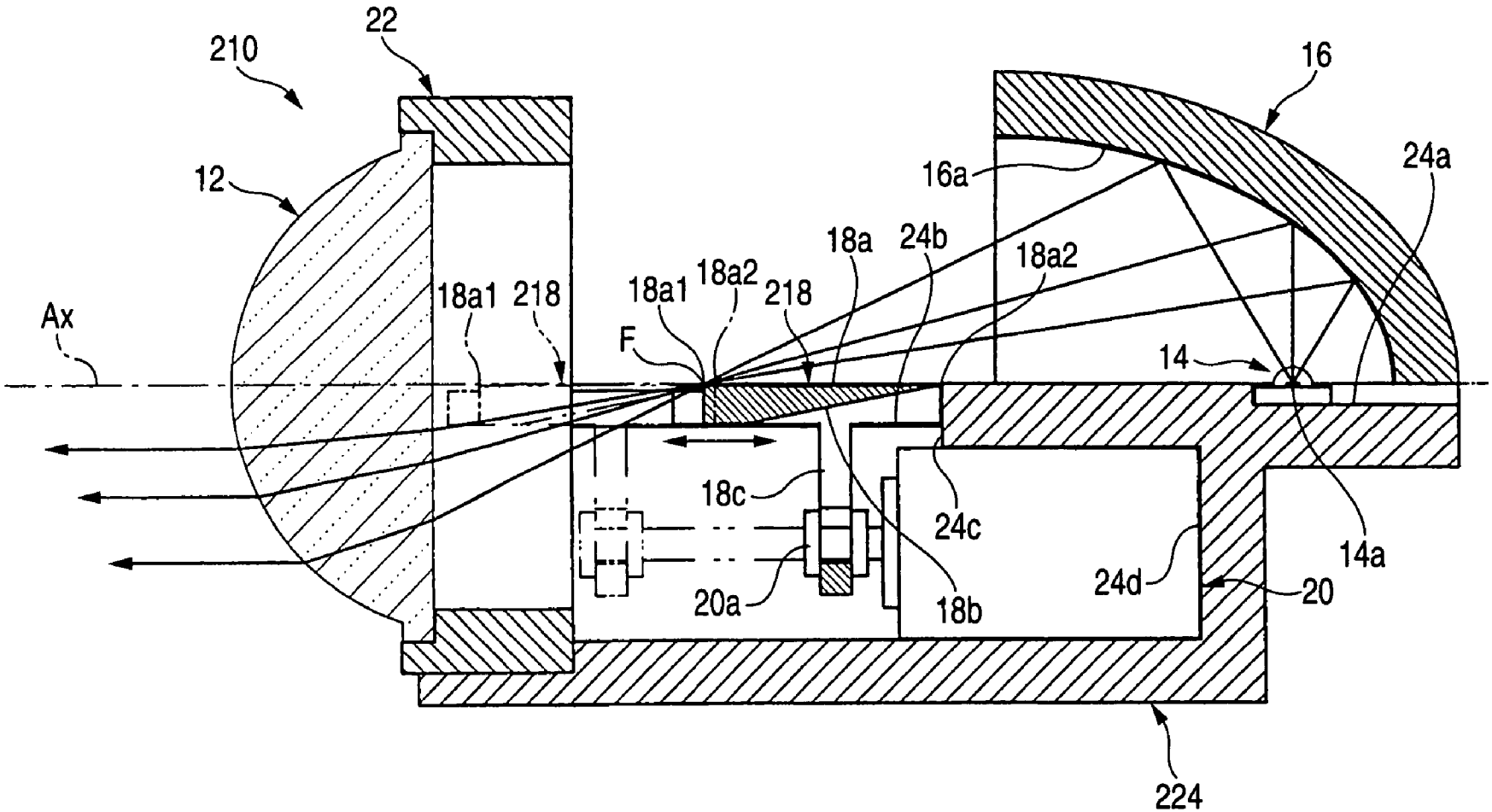
FIG. 11 is a view similar to FIG. 2 showing a lamp unit of a second modification of the exemplary embodiment.
Figure 12:
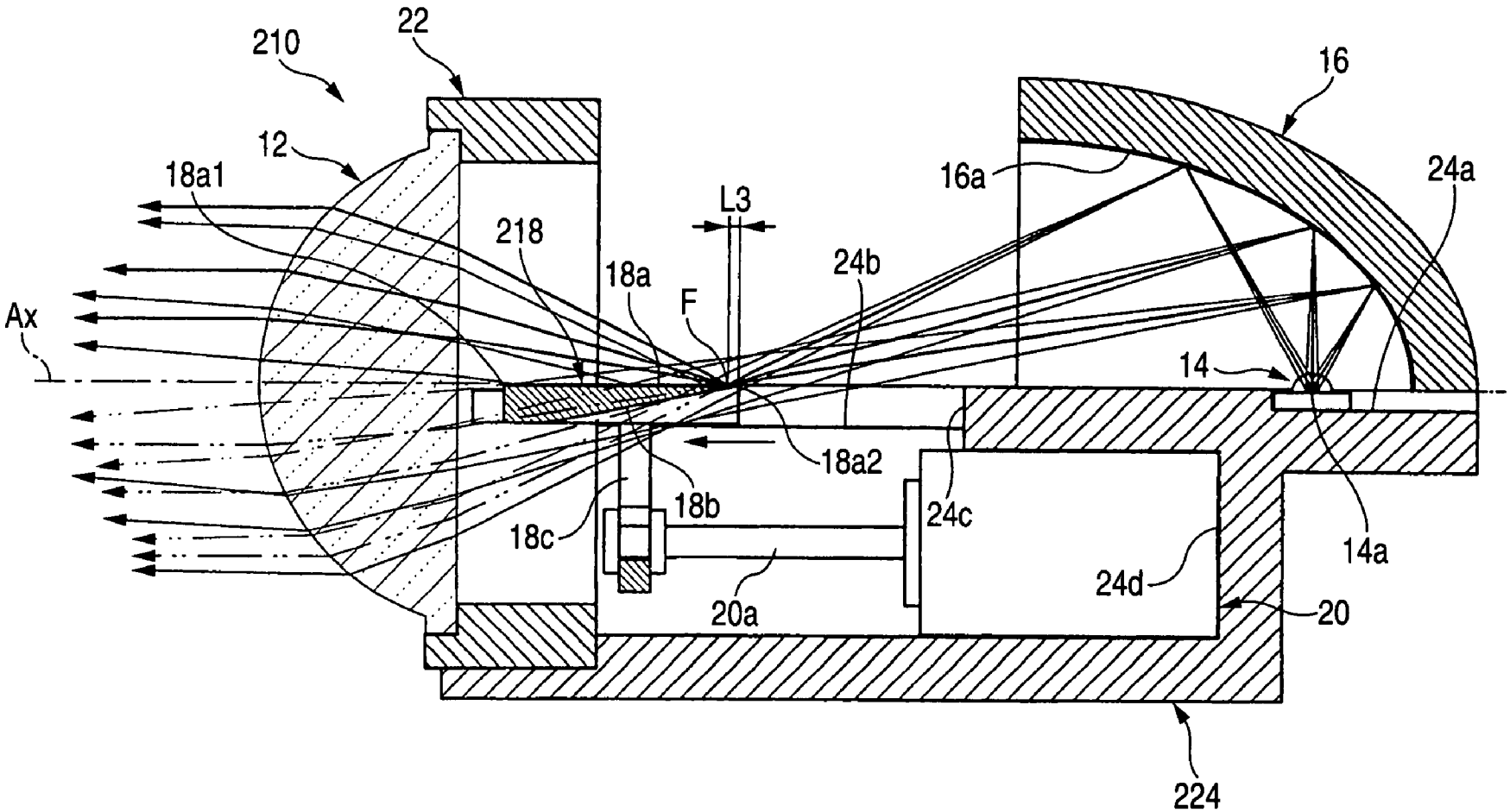
FIG. 12 is a view similar to FIG. 5 showing the lamp unit of the second modification.

FIGS. 11 and 12 are views similar to FIGS. 2 and 5 showing a lamp unit 210 of the modification.

As shown in the figures, in the lamp unit 210, the configuration of a mirror member 218 and a base member 224 is different from that in the first modification, but the rest of the configuration is identical with that in the exemplary embodiment.

In the modification, the longitudinal length of the mirror member 218 is set to be slightly shorter than the mirror member 118 in the first modification. Specifically, in the mirror member 218 in the modification, the front end edge 18*a*1 of the upward reflecting surface 18*a* is located at the same position as the mirror member 118, but the position of the rear end edge 18*a*2 is located slightly forward of the location of the rear edge 18*a*2 of the mirror member 118 of the first modification. According to the configuration, when the mirror member 218 is moved to the front movement position, the rear end edge 18*a*2 of the upward reflecting surface 18*a* is located in the vicinity of the rear focal point F of the projection lens 12 and a predetermined distance L3 (L3<L2) rearward from the rear focal point F.

In accordance with the above, in the base member 224 in the modification, the position of the stopper end face 24*c* is set forward a distance corresponding to the length of L2-L3 more than the base member 124 in the first modification.

Figure 13:
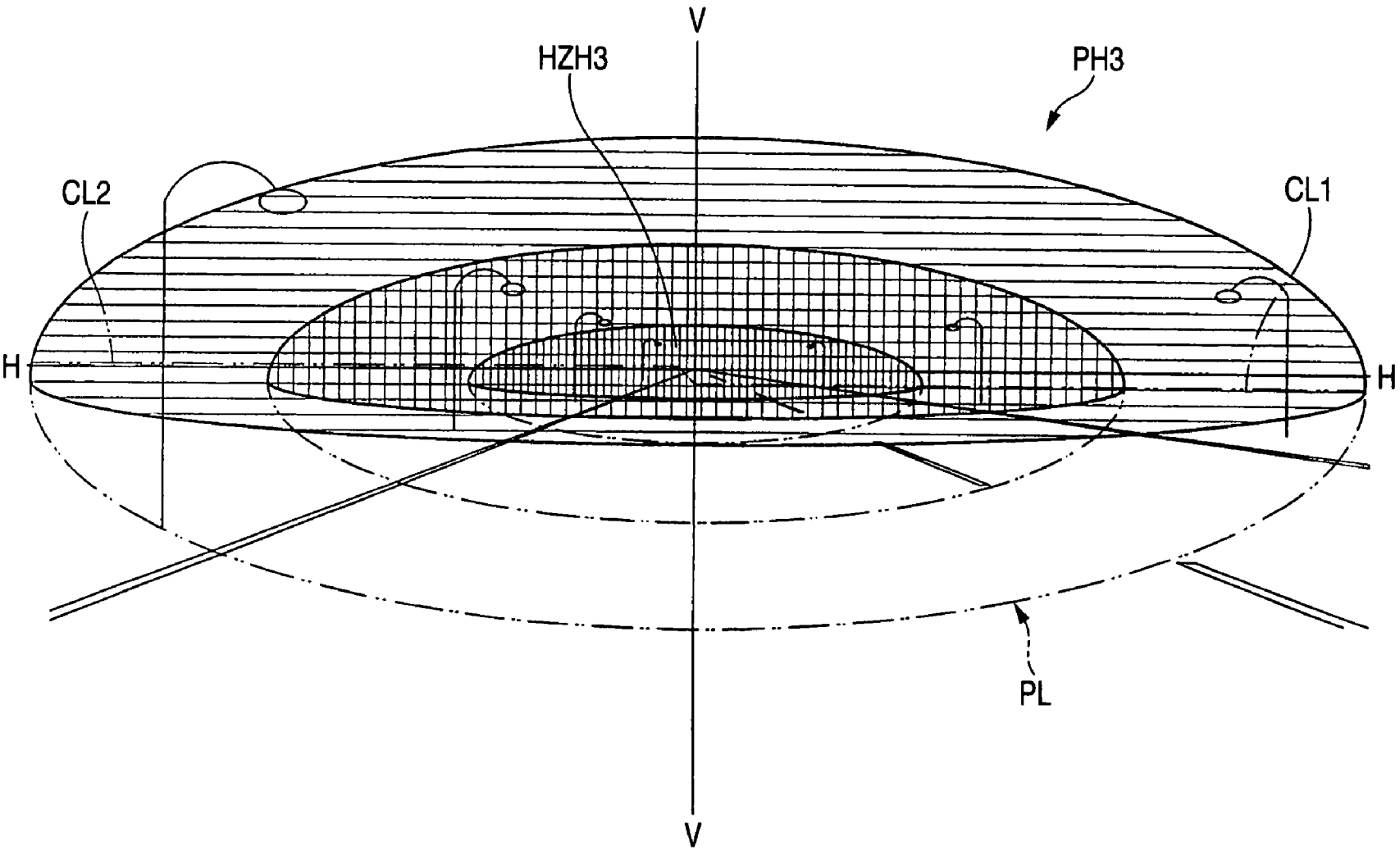
FIG. 13 is a view showing in a transparent manner a high-beam light distribution pattern which is formed on the virtual vertical screen by light forward emitted from the lamp unit of the second modification.

FIG. 13 is a view showing a high-beam light distribution pattern PH3 which is formed on the virtual vertical screen by light that is emitted forward from the lamp unit 210 of the modification.

In the same manner as the high-beam light distribution pattern PH1 in the exemplary embodiment, the upper half portion of the high-beam light distribution pattern PH3 has a shape which is obtained by expanding the low-beam light distribution pattern PL to a position that is substantially vertically symmetric about the lower cut-off line CL1, and the lower half portion has a shape in which the low-beam light distribution pattern PL is slightly flattened toward the lower cut-off line CL1. However, the degree of the flattening is larger than that of the high-beam light distribution pattern PH2 in the first modification. A hot zone HZH3 of the high-beam light distribution pattern PH3 is brighter than the hot zone HZH2 of the high-beam light distribution pattern PH2. Consequently, illumination on a short-distance range of a road surface in front of a vehicle is more effectively suppressed, and the long-distance range of the road surface in front of the vehicle is correspondingly more brightly illuminated, whereby the visibility of the long-distance range is enhanced to a maximum extent.

In this case, the flattening degree of the lower half portion of the high-beam light distribution pattern PH3 is larger than that of the high-beam light distribution pattern PH2 for the following reason. When the mirror member 218 is moved to the front movement position, the position of the rear end edge 18*a*2 is located forward slightly more than that of the mirror member 118 in the first modification. The amount of light, which is reflected by the reflector 16, and which passes through a space in back of the mirror member 218 so as to be incident directly on a lower region of the projection lens 12, is correspondingly larger than that in the case of the mirror member 118.

Also in the lamp unit 210 of the modification, when the mirror member 218 is at the reference position, the low-beam light distribution pattern PL, such as shown in FIG. 6, is formed in the same manner as the exemplary embodiment.

According to this modification, the high-beam light distribution pattern PH3 can have a long-distance visibility which is better than the first modification.

In the above exemplary embodiment and modifications the light-emitting device 14 is placed on the optical axis Ax. However, it is possible to attain the same functions and effects as those of the embodiment and modifications if the device is placed at a position which is slightly deviated from the optical axis Ax.

Moreover, in the above embodiment and modifications the upward reflecting surfaces 18*a*, 118*a*, 218*a* of the mirror members 18, 118, 218 are configured as horizontal faces. However, the upward reflecting surfaces 18*a*, 118*a*, 218*a* may also be configured by a flat face which is slightly inclined with respect to a horizontal plane.

While the invention has been described with reference to the exemplary embodiment and modifications thereof, the technical scope of the invention is not restricted to the description of the exemplary embodiment and modifications thereof. It is apparent to the skilled in the art that various changes or improvements can be made. It is apparent from the description of claims that the changed or improved configurations can also be included in the technical scope of the invention.

What is claimed is:

1. A lamp unit for a vehicle headlamp, comprising:

a projection lens which is placed on an optical axis extending in a longitudinal direction of a vehicle;

a light-emitting device which faces upward and is placed rearward of a rear focal point of said projection lens and in proximity to the optical axis;

a reflector which covers said light-emitting device from an upper side, and which reflects light from said light-emitting device forward while shifting the light toward the optical axis; and a mirror member having an upward reflecting surface which upward reflects part of reflected light from said reflector, said mirror member being disposed between said reflector and said projection lens, wherein said mirror member is configured as a movable mirror member which is movable along the optical axis and able to take a reference position, where a front end edge of said upward reflecting surface of said mirror member is located in a vicinity of the rear focal point, and a front movement position, which is located a predetermined distance forward of the reference position, and when said mirror member is moved to the front movement position, part of reflected light from said reflector is passes through a space behind said mirror member so as to be incident on a lower region of said projection lens.

2. The lamp unit for a vehicle headlamp according to claim 1, wherein said upward reflecting surface of said mirror member is a flat face.

3. The lamp unit for a vehicle headlamp according to claim 1, wherein said mirror member is configured so that, when said mirror member is moved to the front movement position, a rear end edge of said upward reflecting surface of said mirror member is located in a vicinity of the rear focal point.

4. The lamp unit for a vehicle headlamp according to claim 3, wherein said upward reflecting surface of said mirror member is a flat face.

5. The lamp unit for a vehicle headlamp according to claim 1, wherein said mirror member has a substantially wedge-like vertical section shape in which a thickness is gradually reduced as the substantially wedge-like vertical section advances toward a rear end edge of said mirror member.

6. The lamp unit for a vehicle headlamp according to claim 5, wherein said mirror member is configured so that, when said mirror member is moved to the front movement position, a rear end edge of said upward reflecting surface of said mirror member is located in a vicinity of the rear focal point.

7. The lamp unit for a vehicle headlamp according to claim 5, wherein said upward reflecting surface of said mirror member is a flat face.

* * * * *